US006926570B1

(12) United States Patent
Cortez et al.

(10) Patent No.: US 6,926,570 B1
(45) Date of Patent: Aug. 9, 2005

(54) RESCUE APPARATUS

(76) Inventors: Rose Mary Cortez, 4242 Cedar Springs, Apt 223, Dallas, Dallas County, TX (US) 75212; Fernando Valdez, 514 S. Cumberland, Dallas, Dallas County, TX (US) 75203

( * ) Notice: Subject to any disclaimer, the term of this patent is extended or adjusted under 35 U.S.C. 154(b) by 0 days.

(21) Appl. No.: 10/271,482

(22) Filed: Oct. 15, 2002

(51) Int. Cl.[7] ..... B63C 9/13
(52) U.S. Cl. ..... 441/122; 441/81; 441/84
(58) Field of Search ..... 441/80–85, 88, 441/90–93, 98, 107, 120–124; 182/3, 6; 601/151, 601/152; 602/13; 606/202

(56) References Cited

U.S. PATENT DOCUMENTS

| | | | | |
|---|---|---|---|---|
| 157,912 | A | 12/1874 | Gathright | |
| 289,304 | A | 11/1883 | Pealer | |
| 462,081 | A | 10/1891 | Henning | |
| 794,562 | A | 7/1905 | Stabe | |
| 2,031,870 | A * | 2/1936 | Vertuno | 606/202 |
| 2,413,903 | A | 1/1947 | Beehler | |
| 2,459,545 | A | 1/1949 | Schultz | |
| 2,895,147 | A * | 7/1959 | Desjarlais et al. | 441/96 |
| 3,332,415 | A * | 7/1967 | Ericson | 602/13 |
| 3,683,897 | A * | 8/1972 | Shield et al. | 601/34 |
| 3,756,239 | A * | 9/1973 | Smythe | 606/202 |
| 3,888,242 | A * | 6/1975 | Harris et al. | 601/152 |
| 3,933,150 | A * | 1/1976 | Kaplan et al. | 601/151 |
| 4,624,248 | A * | 11/1986 | Poole et al. | 602/13 |
| 4,671,507 | A * | 6/1987 | Huttner | 482/55 |
| 4,694,931 | A * | 9/1987 | Sibertin-Blanc et al. | 182/3 |
| D298,177 | S | 10/1988 | Bonner | |
| 4,813,899 | A * | 3/1989 | Fujimoto | 441/122 |
| 5,823,840 | A * | 10/1998 | Powers | 441/122 |
| 6,379,205 | B1 * | 4/2002 | Wallasch | 441/80 |
| 2001/0046821 | A1 | 11/2001 | Stimpson et al. | |

* cited by examiner

*Primary Examiner*—S. Joseph Morano
*Assistant Examiner*—Ajay Vasudeva
(74) *Attorney, Agent, or Firm*—Baker Botts L.L.P.

(57) ABSTRACT

A rescue apparatus includes a flexible element and a sleeve element. The flexible element may be a rope or tube used to allow the sleeve element to reach a victim. The sleeve element includes at least one pneumatic pillow. The victim inserts an appendage into the sleeve element and the pneumatic pillow is inflated to secure the appendage within the sleeve element. The victim can then be pulled to safety by the flexible element without fear that the victim would lose a grip of the sleeve element.

15 Claims, 1 Drawing Sheet

RESCUE APPARATUS

TECHNICAL FIELD OF THE INVENTION

The present invention relates in general to life saving devices and more particularly to a rescue apparatus requiring minimal effort from the victim.

BACKGROUND OF THE INVENTION

Many life saving devices require a victim to grab onto something and hold on until the victim can reach a safe location accessible to rescue personnel. For example, a rope or flotation device may be thrown or maneuvered into a position where a victim can reach it, hold onto it, and be pulled to safety. A rope or flotation device requires the victim to exert some effort to hold on. However, the victim may not have the strength to hold onto such devices, making it difficult to pull the victim to safety. Therefore, it is desirable to use a device that can assist in saving a victim without requiring effort from the victim.

SUMMARY OF THE INVENTION

From the foregoing, it may be appreciated by those skilled in the art that a need has arisen for a life saving device that reduces an amount of effort required of the victim in using the life saving device. In accordance with the present invention, a rescue apparatus is provided that substantially eliminates or greatly reduces disadvantages and problems associated with conventional life saving devices.

According to an embodiment of the present invention, there is provided a rescue apparatus that includes a flexible element and a sleeve fixed to the flexible element. The sleeve may clasp over an appendage of a victim or have a pneumatic pillow that inflates to secure the appendage of the victim. Inflation of the pneumatic pillow may be activated by the victim at the sleeve or by rescue personnel at a far end of the flexible element.

The present invention provides various technical advantages over conventional life saving devices. Some of these technical advantages are shown and described in the description of the present invention. Embodiments of the present invention may enjoy some, all, or none of these advantages. Other technical advantages may be readily apparent to one skilled in the art from the following figures, description, and claims.

BRIEF DESCRIPTION OF THE DRAWINGS

For a more complete understanding of the present invention and the advantages thereof, reference is now made to the following description taken in conjunction with the accompanying figures, wherein like reference numerals represent like parts, in which.

DETAILED DESCRIPTION OF THE INVENTION

Figure 1:
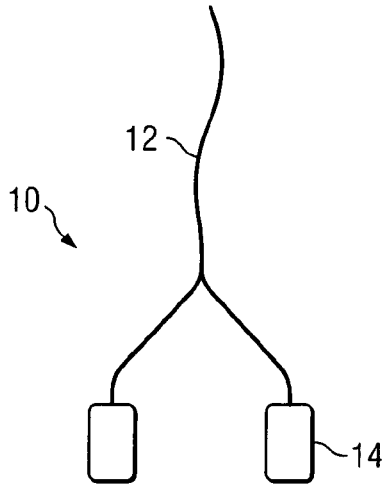
FIG. 1 illustrates a simplified diagram of a rescue apparatus.

FIG. 1 is a simplified diagram of a rescue apparatus 10. Rescue apparatus 10 includes a flexible element 12 and one or more sleeve elements 14. Flexible element 12 may be a long rope or tube that may be extended out to a victim. Sleeve element 14 is fixed to or otherwise attached to flexible element 12. In operation, rescue apparatus 10 is thrown to or otherwise maneuvered towards a victim. The victim would insert an appendage into sleeve element 14 in order to facilitate a rescue or assist the victim to a safe place.

Figure 2:
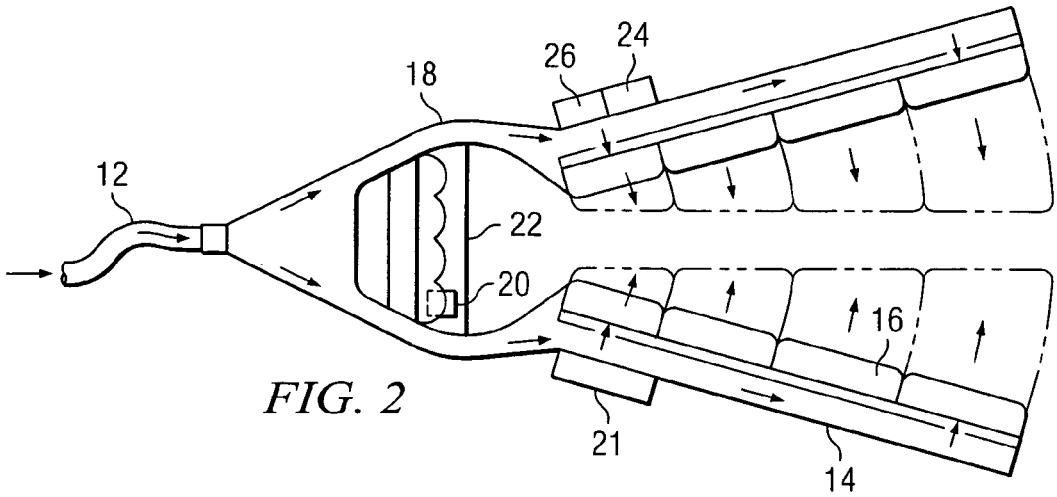
FIG. 2 illustrates a simplified diagram of a sleeve for the rescue apparatus.

FIG. 2 is a simplified diagram of sleeve element 14. Sleeve element 14 is fixed to flexible element 12 and includes one or more pneumatic pillows 16. A handle unit 18 may also be included to connect sleeve element 14 to flexible element 12. An activation unit 20 may be a part of handle unit 18 or sleeve element 14. Activation unit 20 may allow compressed gas to flow into pneumatic pillow 16 in order to inflate pneumatic pillow 16 for the securing of sleeve element 14 to the appendage of the victim. The source of the compressed gas may be local to handle unit 18 or sleeve element 14 or part of activation unit 20. A compressed gas cartridge 21 or other compressed gas source may be fixed to sleeve element 14, handle unit 18, or even flexible element 12 in order to supply compressed gas for inflation of pneumatic pillow 16. The source of the compressed gas may also be at a far end of flexible element 12 where the compressed gas is inserted and allowed to flow through flexible element 12 in order to inflate pneumatic pillow 16 around the appendage of the victim. Alternatively, activation unit 20 may be a part of handle unit 18 or the victim can use the handle unit to manually inflate pneumatic pillow 16 through a pumping or squeezing motion at a handle 22. Activation unit 20 may also allow for the victim to manually inflate pneumatic pillow 16 by blowing into an inflation valve 24 at sleeve element 14. A release valve 26 may be provided to deflate pneumatic pillow 16 in order to release the victim from sleeve element 14.

Sleeve element 14 preferably has an outer shield made of plastic or any other material to protect pneumatic pillow 16 from being punctured. Also, a plurality of pneumatic pillows may be employed within sleeve element 14 with various degrees of inflation pressure to provide comfort to and facilitate securing of the victim's appendage. Alternatively, sleeve element 14 may include cushioning material in place of pneumatic pillow 16 and a clasp mechanism 27 to secure sleeve element 14 around the appendage of the victim. The clasp mechanism may also be implemented in the event that there is a difficulty in inflating pneumatic pillow 16.

Preferably, sleeve element 14 is designed to accept a victim's arm and extends from the wrist to the elbow of a victim's arm. However, sleeve element 14 may be of any length to include extending beyond a victim's elbow or to accommodate a leg of a victim.

Figure 3:
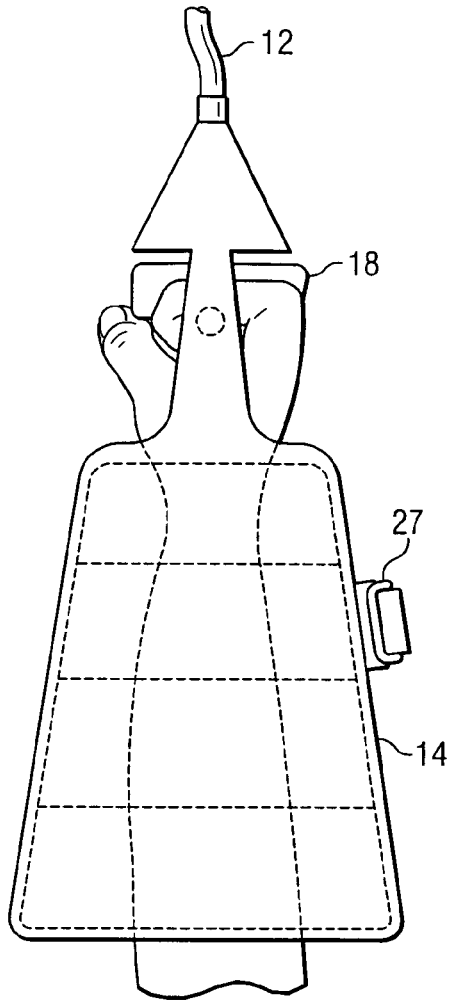
FIG. 3 illustrates a use of the rescue apparatus.

FIG. 3 shows a usage of sleeve element 14. A victim's appendage, namely the hand and arm are slipped into sleeve element 14. Upon inflation of pneumatic pillow 16 by either the techniques provided above or any other inflation technique, the arm becomes secured within sleeve element 14. The victim may then be pulled to safety whether or not the victim has the strength for holding onto to rescue apparatus 10. If the victim does not have the strength to hold onto rescue apparatus 10, the victim may still be pulled to safety as a result of sleeve element 14 securing the victim's arm.

In summary, the rescue apparatus of the present invention provides ease of use with which a victim can insert an appendage into the rescue apparatus. The rescue apparatus can secure the appendage of the victim with minimal effort on the part of the victim. The rescue apparatus can facilitate pulling a victim to safety without requiring the victim to hold on.

Thus, it is apparent that there has been provided, in accordance with the present invention, a rescue apparatus that satisfies the advantages set forth above. Although the present invention has been described in detail, it should be understood that various changes, substitutions, and alterations may be readily ascertainable by those skilled in the art and may be incorporated herein without departing from the spirit and scope of the present invention as defined by the following claims. Moreover, the present invention is not intended to be limited in any way by any statement in the specification that is not otherwise reflected in the appended claims.

What is claimed is:

1. A rescue apparatus, comprising:

a flexible element;

at least one sleeve fixed to the flexible element, the sleeve operable to secure an appendage of a victim to pull the victim by the flexible element to safety without requiring effort from the victim, the sleeve including a pneumatic pillow, the flexible element including a tube to allow compressed gas to flow and inflate the pneumatic pillow in order to secure the appendage of the victim;

an activation unit to allow compressed gas to inflate the pneumatic pillow to secure the appendage of the victim in the sleeve.

2. The rescue apparatus of claim 1, wherein the sleeve includes a clasp mechanism to facilitate latching of the sleeve around the appendage of the victim.

3. The rescue apparatus of claim 1, wherein the sleeve includes an outer shield to protect the pneumatic pillow from being punctured.

4. The rescue apparatus of claim 1, wherein the pneumatic pillow includes a plurality of pillows with varying degrees of inflation pressure.

5. The rescue apparatus of claim 1, further comprising:

a release valve operable to deflate the pneumatic pillow.

6. The rescue apparatus of claim 1, wherein the activation unit inserts compressed gas into the pneumatic pillow in response to triggering at the sleeve.

7. The rescue apparatus of claim 1, wherein the activation unit inserts compressed gas into the pneumatic pillow in response to triggering at the flexible element.

8. The rescue apparatus of claim 1, further comprising:

a second sleeve having a pneumatic pillow, the flexible element operable to allow compressed gas to flow through the tube and inflate the pneumatic pillow of the second sleeve in order to secure a different appendage of the victim or a different victim.

9. The rescue apparatus of claim 1, further comprising:

a handle fixing the sleeve to the flexible element, the handle operable to inflate the pneumatic pillow through manual pumping by the victim.

10. The rescue apparatus of claim 1, wherein the flexible element is a rope.

11. A rescue apparatus, comprising:

a flexible element;

at least one sleeve fixed to the flexible element, the sleeve operable to secure an appendage of a victim to pull the victim by the flexible element to safety without requiring effort from the victim, the sleeve including a pneumatic pillow;

a handle fixing the sleeve to the flexible element, the handle operable to inflate the pneumatic pillow through manual pumping.

12. The rescue apparatus of claim 11, wherein the sleeve includes a clasp mechanism to facilitate latching of the sleeve around the appendage of the victim.

13. The rescue apparatus of claim 11, wherein the sleeve includes an outer shield to protect the pneumatic pillow from being punctured.

14. The rescue apparatus of claim 11, wherein the pneumatic pillow includes a plurality of pillows with varying degrees of inflation pressure.

15. The rescue apparatus of claim 11, wherein the sleeve includes a release valve operable to deflate the pneumatic pillow.

* * * * *